US006367363B1

(12) United States Patent
Widmont

(10) Patent No.: US 6,367,363 B1
(45) Date of Patent: Apr. 9, 2002

(54) DUAL PROTECTIVE SHIELD

(76) Inventor: Richard Frank Widmont, 43 Simard Ave., St. Anne Des Plaines (CA), J0N1H0

( * ) Notice: Subject to any disclaimer, the term of this patent is extended or adjusted under 35 U.S.C. 154(b) by 0 days.

(21) Appl. No.: 09/544,814

(22) Filed: Apr. 7, 2000

(51) Int. Cl.[7] ..... F41H 7/00
(52) U.S. Cl. ..... 89/36.07; 89/36.05; 89/36.02
(58) Field of Search ..... 89/36.05, 36.07, 89/36.02; 2/2.5

(56) References Cited

U.S. PATENT DOCUMENTS

| | | | | | |
|---|---|---|---|---|---|
| 377,732 | A | * | 2/1888 | Adams | 89/36.05 |
| 1,250,197 | A | * | 12/1917 | Louppe | 89/36.05 |
| 2,316,055 | A | * | 4/1943 | Davey | 89/36.05 |
| 3,476,107 | A | * | 11/1969 | Matt, Jr. et al. | 89/36.05 |
| 4,412,495 | A | * | 11/1983 | Sankar | 109/49.5 |
| 4,782,735 | A | * | 11/1988 | Mui et al. | 89/36.07 |
| 4,843,947 | A | * | 7/1989 | Bauer et al. | 89/36.05 |
| 5,329,636 | A | * | 7/1994 | Siddle | 2/2 |
| 5,377,577 | A | * | 1/1995 | Bounkong et al. | 89/36.05 |

FOREIGN PATENT DOCUMENTS

| | | | | |
|---|---|---|---|---|
| GB | 2209820 | * | 5/1989 | 89/36.05 |
| IT | 312326 | * | 3/1937 | 89/36.07 |

* cited by examiner

*Primary Examiner*—Stephen M. Johnson
(74) *Attorney, Agent, or Firm*—Richard J. Hicks

(57) ABSTRACT

The invention relates to a shield operable by two persons. This shield advantageously comprises in combination: a shield body, said shield body having a front face and a rear face; at least first handling means positioned in central portion of a width of the rear face of said shield and intended to be shared by said persons; at least second handling means positioned in a periphery portion of the rear face of the shield and intended to be used by one of said persons; and at least third handling means positioned in a periphery portion of the rear face of the shield and intended to be used by the other of said persons. The said shield is utilized for protection in order to secure an aggressive individual within an enclosed area. It can also be used in riot control to prevent an aggressive crowd from advancement.

7 Claims, 7 Drawing Sheets

DUAL PROTECTIVE SHIELD

BACKGROUND—FIELD OF INVENTION

Figure 1:
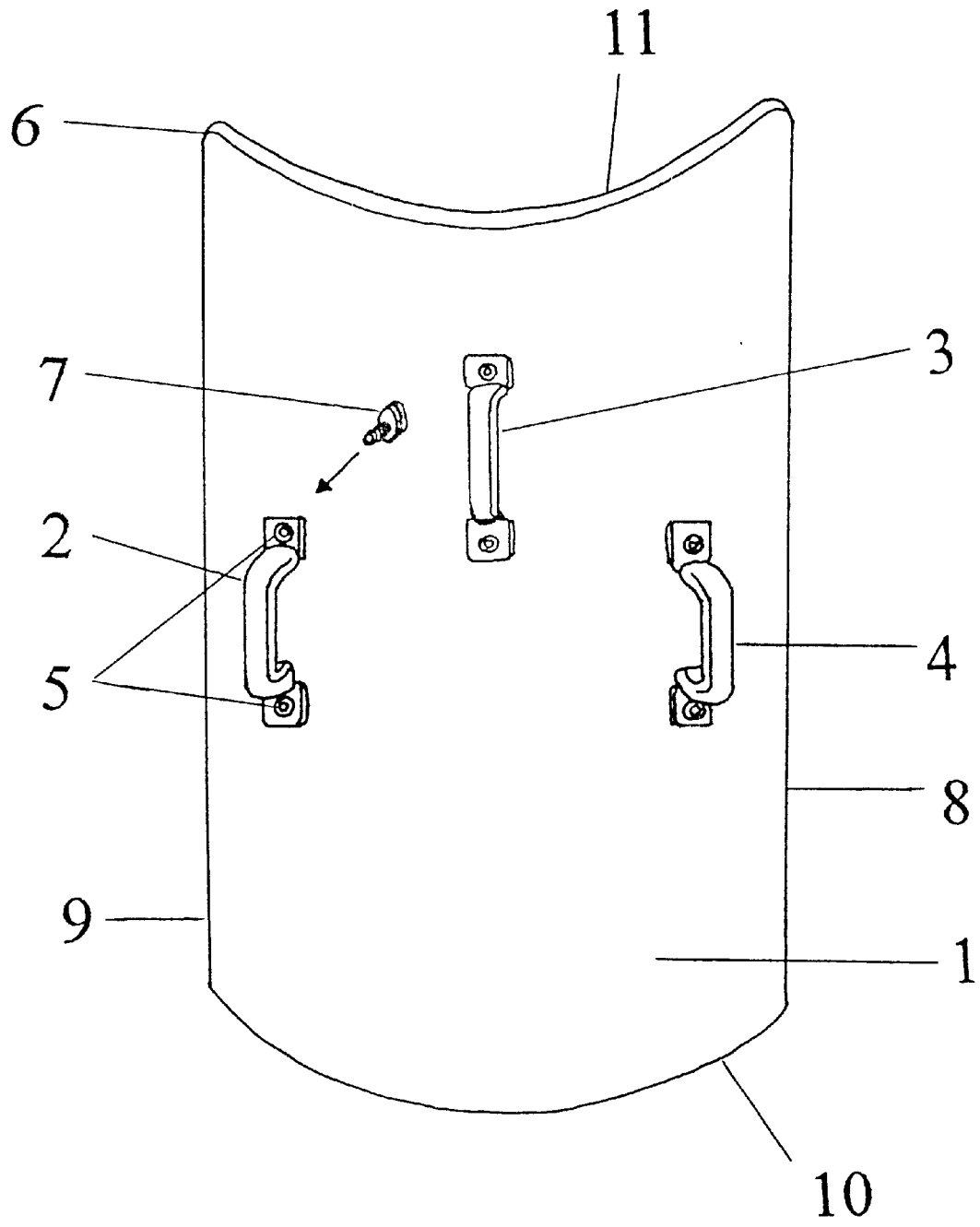

This invention relates to the field of law enforcement, specifically to a safety device to protect officers from injury while trying to neutralize an individual.

BACKGROUND OF THE INVENTION

Law enforcement officers are frequently required to neutralize an aggressive individual. Normally, a protective shield is utilized in interventions in order to immobilize the individual, and thereby decrease the chance of injury to the individual as well as the officers involved in the intervention. Normally, the largest and heaviest officer on the shift is placed in the responsible position behind the shield requiring him to immobilize the inmate while the other officers try to support him from behind.

Officers are vulnerable if this particular officer loses control of the protective shield. In addition, the officer controlling the shield is facing straight towards the aggressor in order to maintain support of the particular shield. Moreover, the pinning of the aggressor on the floor makes it very cumbersome for the officer working the shield. This could in fact sometimes lead to injuries of either the aggressive individual or the officers.

The solution to this problem is to facilitate interventions and reduce the risk by dividing responsibilities and having two men handle the shield. A shield that will allow us to enter into the same small enclosed areas, but rather have two officers supporting the shield. Four hands are stronger than two and four legs much stronger than two. Also the weight factor is increased. Moreover, with two officers sharing the shield, it is better secured and ameliorates mobilization of the officers, as well as immobilization of the aggressive individual. Especially, positioning of the officers once the aggressive individual is pinned to the floor, etc.

Shield type devices have been utilized in Law enforcement application for years. Large shields as well as some smaller types have been incorporated as protection during riots. The law enforcement shields heretofore known suffer from the following disadvantages:

(a) The present shields make the officers vulnerable to an offensive attack.

(b) The dependence of shield handling is placed on the officer operating the shield.

(c) The shields do not allow an officer to position himself in a protective stance while maneuvering said shield.

(d) The present shields do not permit for the officer to have maximal control of the shield.

(e) The placement for the officer intervening with the shield does not place him in an advantageous position of strength once the inmate is neutralized on the floor.

(f) The present day shields utilized by peace officers do not permit removal of hand grasp on the handle in order to assist or protect oneself or others during an intervention.

OBJECTS AND ADVANTAGES

Accordingly, several objects and advantages of my invention are:

(a) To provide a shield with a clear impact resistant body to allow the officers to monitor the prisoners during use.

(b) To provide a shield of a size which can be used in the same confined spaces of present day use while allowing more security for officers as well as the prisoner.

(c) By allowing officers to work in a pair with the shield enables for better teamwork as well as justifying each others actions in the court of law if need be.

(d) To provide a shield that because of its convex shape and the utilization of two officers enables them to immobilize a subject on the floor without placing themselves in a vulnerable position.

(e) To provide a shield that will enable the teamwork concept be in optimal use. Example: If one of the officers supporting the shield was to get injured, control of the shield is not jeopardized, because the other officer still has control. As well, the back up man could replace the injured officer without placing his life in danger and taking grasp of the shield that is in position still.

(f) To provide greater strength, more confidence, more weight and better control of the shield during emergency situations.

(g) The three handles which allow the middle handle to be manipulated by both officers at close range also enables them to realize if one or the other is in peril. But also that one officer can maintain the shield until his backup replaces the injured officer.

Further objects and advantages will become apparent from a consideration of the ensuing description and drawings.

DRAWING FIGURES

FIG. 1 shows a view of the shield parts.

Figure 2A:
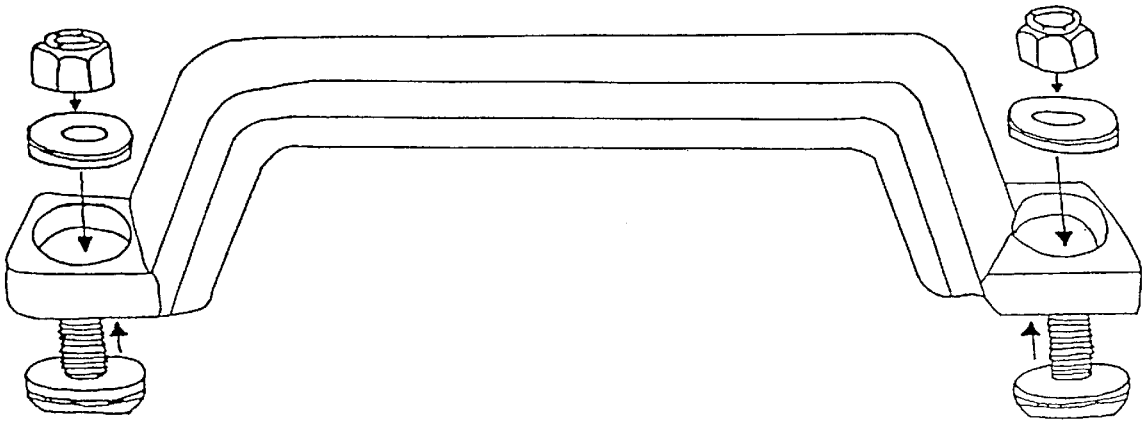

FIG. 2*a* shows an exploded view of the handle.

Figure 2B:
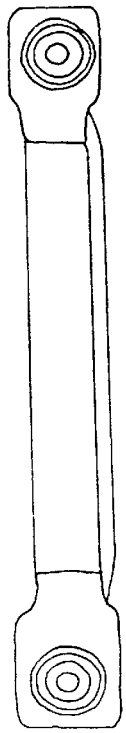

FIG. 2*b* shows an exploded front view of handle installation.

Figure 2C:
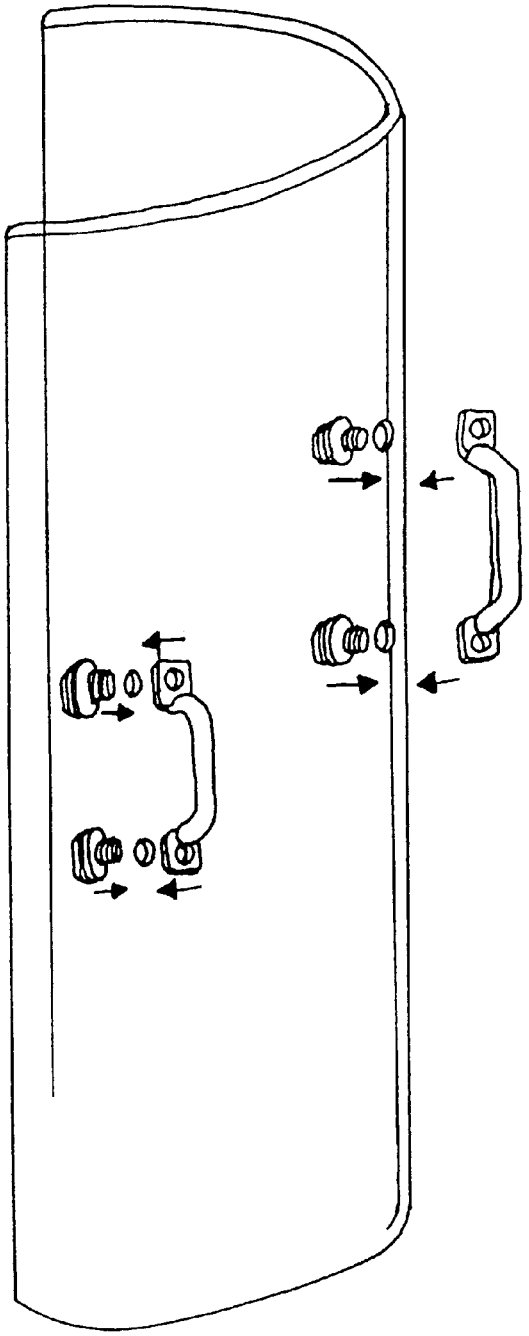

FIG. 2*c* shows a view of handle installation (side view).

Figure 3A:
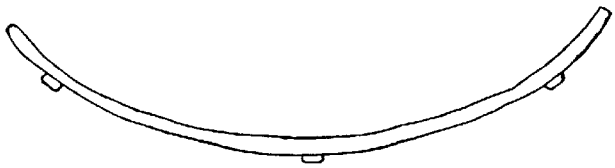

FIG. 3*a* is an overview of the assembly.

Figure 3B:
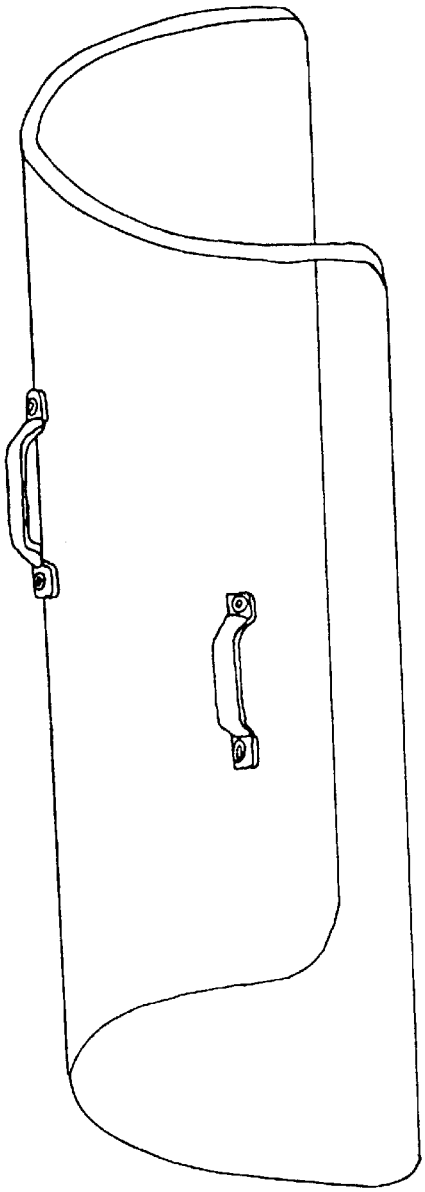

FIG. 3*b* is a side view of the assembly.

Figure 3C:
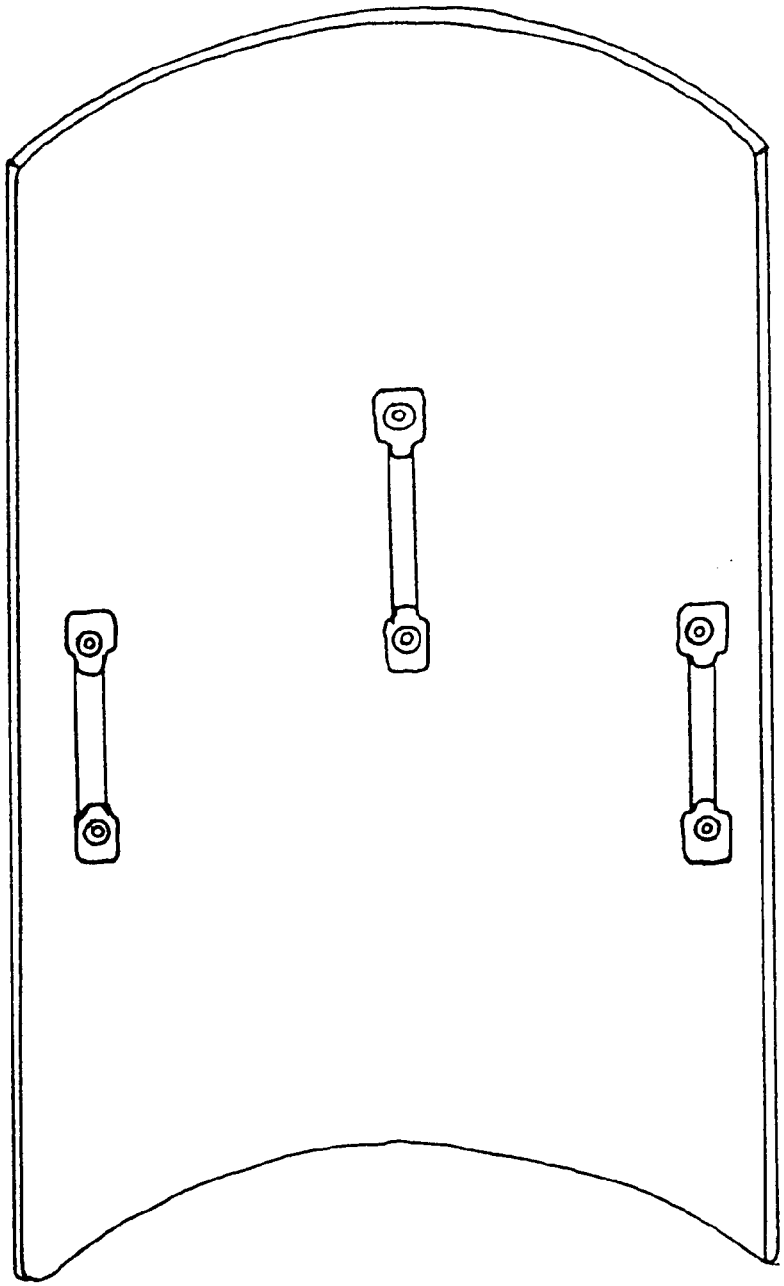

FIG. 3*c* shows a front view.

Figure 4A:
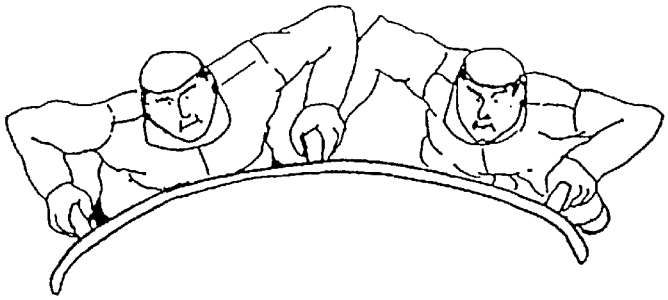

FIG. 4*a* is an overview with two officers in position.

Figure 4B:
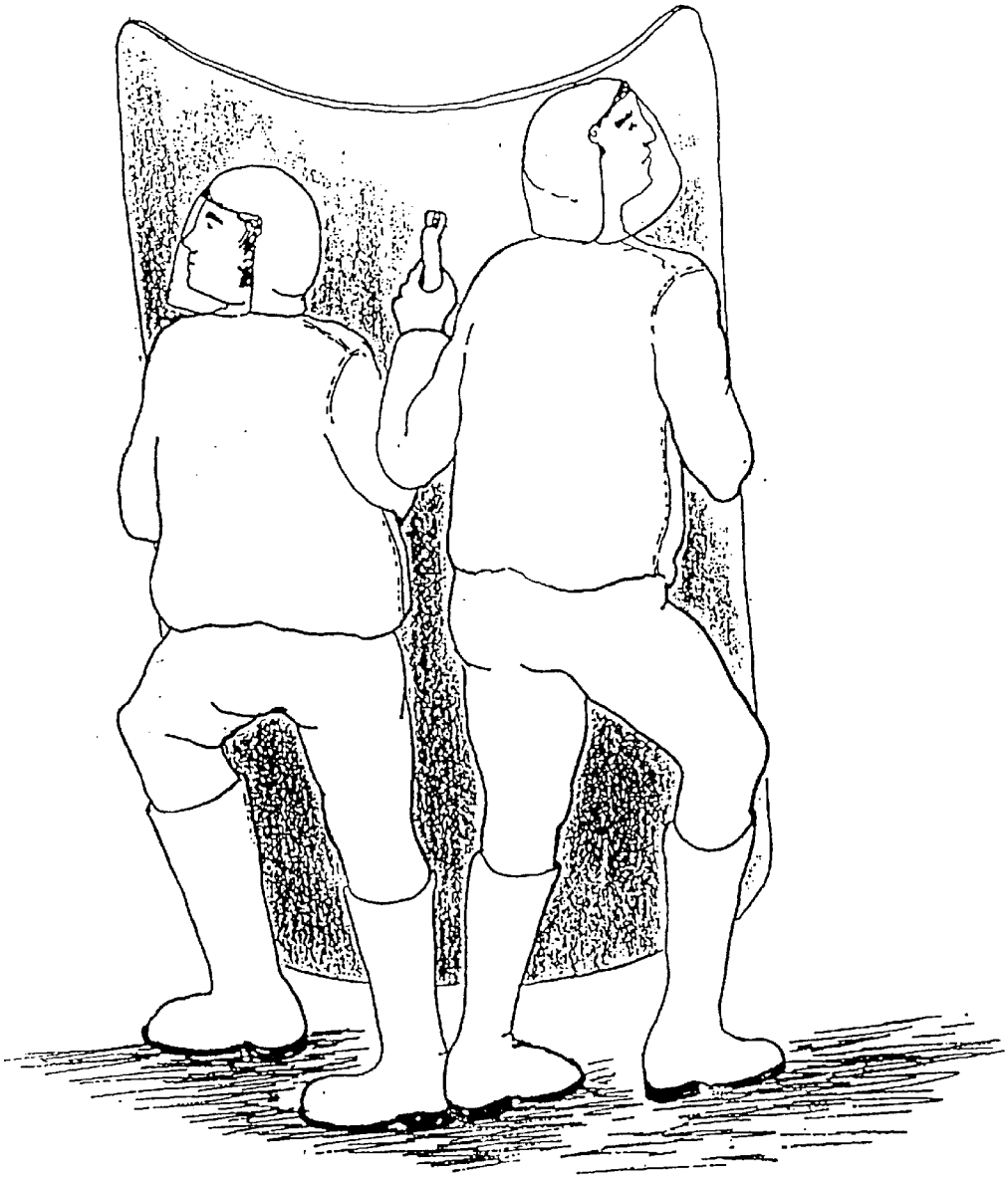

FIG. 4*b* is a rearview with two officers handling the shield.

Figure 4C:
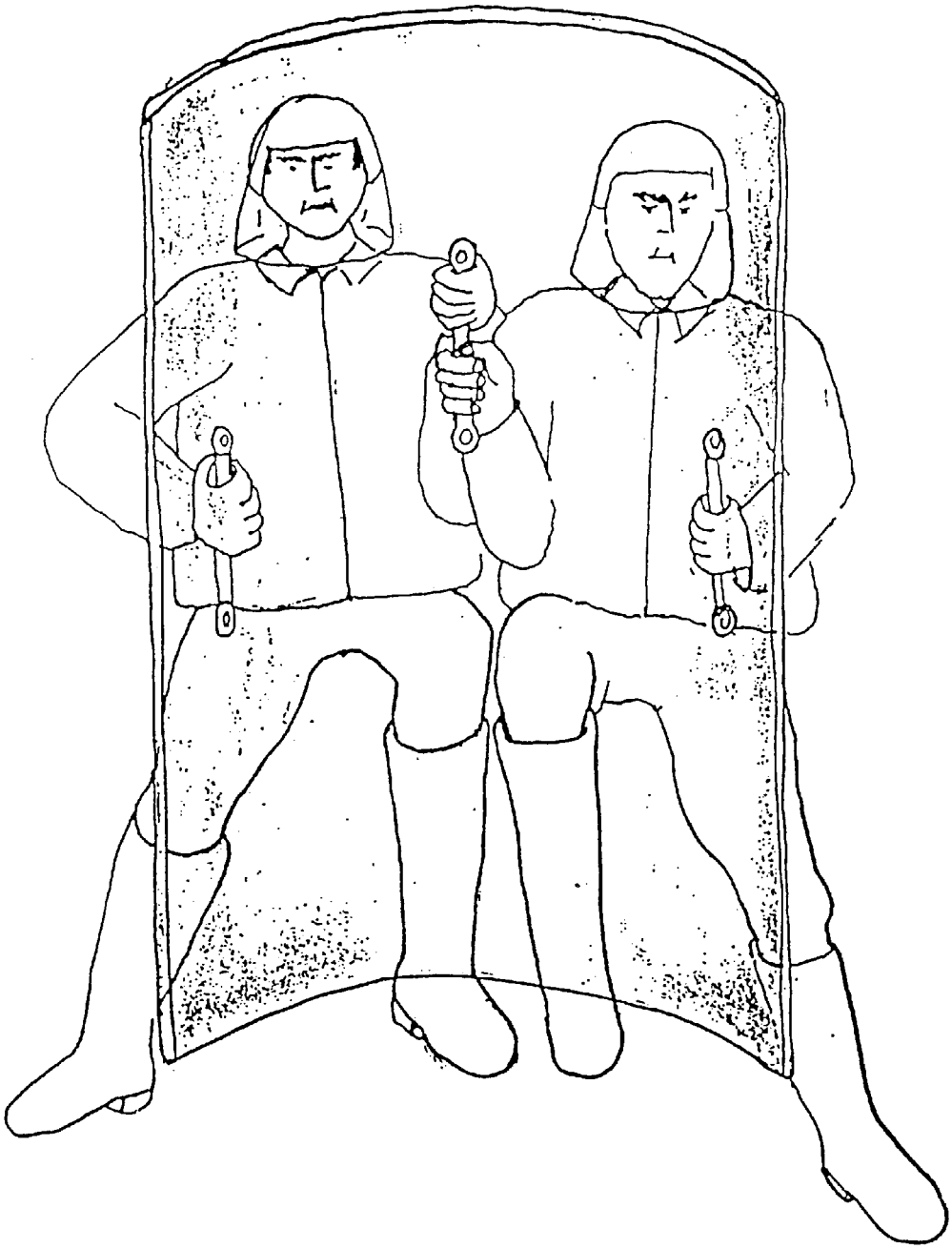

FIG. 4*c* is a front view of the assembly with two officers.

REFERENCE NUMBERS IN DRAWINGS

1 Shield body
2 Left handle
3 Middle handle
4 Right handle
5 Screw holes (for fasteners)
6 Rounded corners
7 Fastener
8 Right side edge
9 Left side edge
10 Bottom edge
11 Top edge

SUMMARY OF THE INVENTION

The invention relates to a shield operable by two persons. This shield advantageously comprises in combination:

a shield body having a concave front face and a convex rear face;

at least first handling means positioned in central portion of a width of the convex rear face of said shield and intended to be shared by said persons;

at least second handling means positioned in a periphery portion of the rear face of the shield and intended to be used by one of said persons; and at least third handling means positioned in a periphery portion of the rear face of the shield and intended to be used by the other of said persons.

Advantageously, the shield body is curved to define a concave front face.

Advantageously, the shield has rounded corners with peripheral edges.

Advantageously, the handling means are handles and preferably loop handles.

Advantageously, the shield according to the invention is a one unit assembly that is manoeuvred simultaneously by two persons.

DETAILED DESCRIPTION OF THE INVENTION

A preferred embodiment of the shield in reference to present invention is illustrated in FIG. 1 (view of the shield parts). A preferred assembly shown in FIGS. 2*a* and 2*b* (exploded views) and FIG. 2*c* (side view). FIGS. 3*a* (overview), 3*b* (side view) and 3*c* (front view). Finally, FIGS. 4*a* (overview with two officers), 4*b* (rearview with two officers handling) and 4*c* (front view with two officers).

A shield body (1) may be constructed of a clear impact resistant plastic sheet material. The shield body (1) is advantageously of concavo-convex shape on a 3" parallel. The thickness of plexiglass is advantageously 0.177" and the dimensions of roughly 24" by 48". All edges (8, 9, 10, 11) may be peripheral and rounded to avoid personal injury and snagging. All edge corners (6) are advantageously rounded to prevent personal injury.

Three handles (2, 3, 4) are preferably constructed from urethane rubber or cast iron (eg. 10" length by 1" diameter). The handles (2, 3, 4) may be secured onto the shield by a fastener (7) being tapped through the concave front face of shield to a receiver (nut). Fastener (7) may be a fine thread bolt with preferably an allen key operated head surface that is flat. As illustrated, the fastener (7) may pass through a hole (5) which may be drilled to a diameter of roughly 0.79 cm (5/16 in). The preferable flat surface of the fastener (7) will assist in avoiding injury and snagging.

The middle handle (3) is advantageously centered laterally on the shield (1). Preferably, the middle handle (3) is positioned 29.2 cm (11½ in) from the side edges of said shield (1). The middle handle (3) is preferably positioned 28 cm (11 in) from the top edge (11) and 68.6 cm (27 in) from the bottom edge (10). The side handles (2, 4) may be each roughly 5.1 cm (2 in) from each side edge (8, 9) and 20.3 cm (8½ in) from the middle handle (3). The side handles (2, 4) may be roughly 48.3 cm (19 in) from the bottom edge (10) and 48.3 cm (19 in) from the top edge (11). The inferior fastener (7) of the middle handle (3) is preferably fastened on the same level as the superior fasteners (7) of the outer handles (2, 4).

According to a particularly preferred embodiment of the invention, distances of holes and handles placement may be as illustrated in FIG. 1., refer to FIG. 1.

From the description above, a number of advantages of the shield according to the invention and having a triple handle concept become evident.

(a) The handles permit for better control of shield.

(b) The clear resistant plexiglass body allows an officer to visually monitor the prisoner while using shield.

(c) It also provides the officers with necessary protection of assisting one another at close range (better backup in legal proceedings).

(d) The rounded corners and edges as well as the countersunk fastener reduce the risk of personal injury to the officer and aggressor.

(e) The positioning of the officers behind the shield permits for better defensive stance (greater protection from an offensive).

(f) Two officers manipulating the shield makes for a more intimidating image thereby psychological weakening of the aggressor.

(g) Greater strength and weight permit to facilitate and expedite interventions, thereby reducing chances of injury.

The manner of using said shield according to the invention, such as the preferred shield illustrated in FIG. 1 and having three loop handles that are vertically positioned and equally separated at the center section of the shield is different from shields presently in use. The three handles grasps (2, 3, 4) with the shield body (1) are positioned so that the users share the middle handle (3) while having their other hands separately on the outer handles (2, 4). There are always two officers to control this shield. The handles (2, 3, 4) are preferably placed in a vertical position which permits the hand positions to be more anatomically natural. The middle handle (3) may be placed at a higher level than the two outside handles (2, 4) to permit a greater stability and strength when handling shield. The use of two officers permits greater mobility and control of aggressor.

SUMMARY, RAMIFICATIONS AND SCOPE

Accordingly, the reader will see that the shield according to the invention, preferably a clear resistant shield utilizing three looped handles, is easily and naturally operated by two operators. It also serves to provide effective protection for officers while securing a prisoner etc. 1. Permits the officers to monitor each other at close hand while intervening. 2. The said shield is of a standard size that permits officers to enter into enclosed spaces. 3. It can be operated outdoors to prevent aggressive crowds from advancement into a building etc. 4. Mobility of the officers is ameliorated.

Although the description above contains many specificities, these should not be construed as limiting the scope of the intervention, but as merely providing illustrations of some of the presently preferred embodiments of this invention. Some examples, the shield can be of a different size, shape or material to be better used in different applications. The handles may be of a different size, shape, or number but this will not alter this invention, as long as it is maintained as a two man shield.

Thus, the scope of the invention should be determined by the appended claims and their legal equivalents, rather than by the examples given.

The embodiments of the invention in which an exclusive right of property or privilege that I claim as my invention is:

1. A shield, operable by two persons, comprising:

(a) a substantially rectangular, transparent, impact resistant, rigid plastic shield body having top and bottom edges, opposed parallel longitudinal side edges, a concave front face and a convex rear face;

(b) first rigid handle means centrally and rigidly mounted on, and projecting rearwardly from, said convex rear face; said first handle means being of sufficient size to be firmly grasped by one hand of each of said persons;

(c) second rigid handle means rigidly mounted on, and projecting rearwardly from, said convex rear face adjacent one said longitudinal side edge thereof; said second handle means being of sufficient size to be grasped by at least a second hand of a first one of said persons; and (d) third rigid handle means rigidly mounted on, and projecting rearwardly from, said convex rear face adjacent a second said longitudinal side edge thereof; said third handle means being of sufficient size to be grasped by at least a second hand of a second one of said persons.

2. A shield as claimed in claim 1 wherein said second and third handle means are spaced equidistantly between said top and bottom edges of said shield body and said first handle means is mounted between said top edge and said second and third handle means.

3. A shield as claimed in claim 1 wherein said handle means are loop handles.

4. A shield as claimed in claim 1 wherein said shield body has rounded corners.

5. A shield as claimed in claim 1 wherein said shield body is a plexiglass body.

6. A shield as claimed in claim 1 wherein said handle means are fabricated from a material selected from the group consisting of urethane rubber and cast iron.

7. A shield as claimed in claim 1, wherein said first, second and third handle means are equally sized.

* * * * *